US005476518A

United States Patent [19]

Caleshu

[11] Patent Number: 5,476,518

[45] Date of Patent: Dec. 19, 1995

[54] PROCESS FOR PRODUCING TWO-TONED LUSTROUS EFFECTS IN DYED FABRICS

[75] Inventor: Nicholas Caleshu, Coventry, R.I.

[73] Assignee: A. Wimpfheimer & Bro., Inc., Stonington, Conn.

[21] Appl. No.: 403,343

[22] Filed: Mar. 14, 1995

[51] Int. Cl.[6] ..... D06M 11/00

[52] U.S. Cl. ..... 8/115.69; 8/115.68; 8/130; 8/131; 8/132; 8/488; 8/929; 8/536; 8/921

[58] Field of Search ..... 8/115.68, 131, 8/132, 488, 929, 536, 921, 115.69, 114, 114.6, 115, 130

[56] References Cited

U.S. PATENT DOCUMENTS

| | | | |
|---|---|---|---|
| 8,303 | 8/1851 | Mercer . | |
| 665,680 | 1/1901 | Heberlein . | |
| 1,058,459 | 4/1913 | Petzold . | |
| 1,991,886 | 2/1935 | Ellis | 8/921 |
| 2,142,043 | 12/1938 | Boyd . | |
| 2,524,113 | 10/1950 | La Piana . | |
| 2,769,685 | 11/1956 | Cowles et al. . | |
| 4,368,055 | 1/1983 | Motzkus et al. | 8/115.69 |
| 5,407,448 | 4/1995 | Brandt et al. | 8/488 |

FOREIGN PATENT DOCUMENTS 59-66568 4/1984 Japan .

*Primary Examiner*—Prince Willis, Jr.
*Assistant Examiner*—Alan D. Diamond
*Attorney, Agent, or Firm*—Albert W. Hilburger; Michael J. Tully

[57] ABSTRACT

A process for treating a dyed, velvet fabric is disclosed wherein two-toned color effects between the pile and the fabric backing are achieved. The preferred fabric comprises a cellulosic (cotton or rayon) or synthetic fiber weave backing dyed preferably with a non-disperse dye, e.g. a direct dye, and pile composed of cellulose acetate fibers dyed with a disperse dye. The dyed fabric is contacted with a dilute caustic solution, e.g., sodium hydroxide, for a period of time sufficient to at least partially or totally hydrolyze the cellulose acetate of the pile fiber, which noticeably also reduces the color intensity of the pile while having little effect on the color intensity of the backing. This is followed by rinsing, neutralization and conditioning of the treated fabric.

20 Claims, No Drawings

PROCESS FOR PRODUCING TWO-TONED LUSTROUS EFFECTS IN DYED FABRICS

BACKGROUND OF THE INVENTION

1. Field of the Invention

The invention relates to a process for treating dyed velvet fabrics to achieve two-toned, lustrous effects.

2. Description of Related Art

Mercerization is a well known technique for treating natural cellulosic fibers, e.g. cotton or rayon fibers, in order to enhance the luster, strength and feel of the fiber. In accordance with this process, the yarn or fabric is immersed in a 20–30% by weight aqueous solution of alkali hydroxide maintained at a temperature normally below 200° F., usually 50°–90° F. until the fibers swell and become plastic. After removal from the alkali solution, the resulting alkali cellulose fibers are tentered to avoid shrinkage and washed with hot water, optionally containing a neutralizing acid, to progressively remove the alkali. Progressive replacement of alkali with water leads to the development of stable Cellulose II or cellulose hydrate I fiber. The resulting fibers or fabrics are then dried. In instances where the fibers or fabrics are to be dyed, the dying normally takes place after mercerization. This general process was first described by John Mercer in U.S. Pat. No. 8,303, issued Aug. 19, 1851.

Variations of the mercerization process are also disclosed in U.S. Pat. Nos. 1,058,459, 2,142,043, and 2,769,685.

U.S. Pat. No. 665,680 discloses a process for preparing cellulose-based textile yarns of enhanced luster comprising immersing the yarn in an alkaline solution containing a colloid such as starch, either before or after dying the yarn.

In another process disclosed in U.S. Pat. No. 2,524,113, rayon textile fabrics are first treated with an aqueous solution containing a water soluble reaction product of formaldehyde, lactic acid, ethanol and urea, followed by treatment with an aqueous caustic solution which stabilizes the treated fabric. Two-tone dye effects may be achieved by applying the caustic only in a pattern, e.g. stripes or designed patterns, followed by dying. The pattern area treated with caustic exhibits a greater affinity for dyestuffs than the non-treated area, thereby leading to two-tone effects.

Two-toned effects in woven fabrics such as velvets, which comprise a woven backing containing short pile fibers, may be achieved by using pre-dyed yarn fibers of different colors for the backing and the pile yarns, but this adds considerably to the expense of apparel manufacture. Another technique for obtaining colored velvets is to employ yarns of different chemical composition for the backing and pile fibers in the construction of an undyed velvet composite, and then dye the composite using a dye which has an affinity for dying only the backing fibers, or using a dye bath containing two chemically different dyes, one of which has a greater affinity for dying the pile fibers and the other of which has a greater affinity for dying the backing fibers. However, these techniques produce two-toned fabrics of either excessive color contrast or of very poor color contrast as between the pile and backing fibers.

SUMMARY OF THE INVENTION

The present invention provides a process for treating a dyed, velvet fabric to achieve a shining, silvery, eye-pleasing color contrast between the pile fibers and backing fibers present in the velvet weave. In accordance with the process of this invention, a velvet fabric composed of a dyed, weaved fiber backing and containing pile fibers comprising cellulose acetate dyed with a disperse dye is contacted with a dilute aqueous alkali solution for a period of time sufficient to at least partially hydrolyze the cellulose acetate present in the pile fiber but insufficient to substantially degrade any of the fibers present in the fabric. The fabric is then separated from the alkali solution and rinsed with rinse water to remove excess alkali present in the fabric. The alkali treatment noticeably reduces the color intensity of the pile fibers and imparts a shiny, silvery hue thereto, while having little or only moderate effect on the color intensity of the backing. The rinsed fabric may then be subsequently neutralized to near neutral pH by a wash in water containing dilute acid, and is then preferably conditioned by a wash in water containing a cationic or non-ionic softening agent, followed by tentering and drying the fabric.

In a more preferred process, a dyed velvet fabric composed of a backing of weaved rayon, cotton or a blend thereof, which is dyed using a direct dye, which fabric also contains cellulose monoacetate pile fibers dyed with a disperse dye, is subjected to a process comprising: (a) contacting the dyed fabric with an aqueous solution containing from about 0.75 to about 3.0 percent by weight caustic (sodium hydroxide) maintained at a temperature in the range of about 100° F. to 200° F. for a period of time of at least about 10 minutes and sufficient to at least partially or totally hydrolyze the cellulose acetate present in the pile fibers but insufficient to substantially degrade any of the fabric fibers; (b) separating the fabric from the caustic solution; (c) rinsing the fabric with rinse water to remove excess alkali present in the fabric; (d) contacting the rinsed fabric with a dilute aqueous acidic solution for a period of time sufficient to lower the pH of the fabric to about neutral pH; (e) contacting the neutralized fabric with an aqueous solution containing a non-ionic or cationic fabric softening agent; and (f) tentering and drying the product from step (e).

DETAILED DESCRIPTION OF THE INVENTION

The velvet fabrics which are treated in accordance with this invention are composed of a woven backing of weft and warp yarns and having pile fibers woven into the backing yarns by methods well known in the art. The pile fibers normally are of a height in the range of from about $5–7\times10^{-2}$ inch. The backing yarns may be composed of natural cellulosic fibers such as cotton, animal fibers such as wool, rayon or synthetic fibers such as polyester, nylon, acrylic and aramide fibers, as well as mixtures of such fibers, including mixtures of one or more of such fibers also containing less than about 50% by weight of cellulose acetate fiber. The preferred fibers for the fabric backing are rayon, cotton and mixtures thereof. Rayon is most preferred.

The pile fibers present in the fabric are composed primarily of cellulose acetate, e.g., cellulose monoacetate, cellulose diacetate or cellulose triacetate, or mixtures of such fibers. The pile fibers may also be blended with minor amounts, e.g., less than about 30% by weight of one or more of the natural or synthetic fibers used to form the backing component of the fabric, e.g., a polyester fiber. The most preferred pile fiber consists of cellulose monoacetate.

The invention is grounded on the discovery that eye pleasing, two tone, lustrous effects can be achieved in velvet fabrics composed of a dyed backing and dyed pile where the dyed pile comprises cellulose acetate fiber dyed with a disperse dye. Contact of the fabric with dilute alkali solution under mild hydrolysis conditions hydrolyzes at least some of ester groups present in the dyed cellulose acetate pile fiber, leading to the development of a regenerated cellulose fiber. Hydrolysis also simultaneously effects a reduction in the color intensity of the pile, while having little or only moderate effect on the color intensity of the backing material. The resulting velvet exhibits a two-toned effect between the backing and the pile, with the pile exhibiting a shiny almost silvery appearance in contrast with the darker color tone of the backing material. This two-toned, luxurious effect is created as a consequence of using fibers of different chemical composition in the construction of the pile and backing of the velvet, as well as using different classes of dyestuffs to color the pile and the backing fibers.

The backing may be dyed using any suitable non-disperse dye which is conventionally used to dye fibers of the type used in the construction of the backing. These include direct, acid, basic, vat, azoic and sulfur dyes. Where the backing is composed of rayon or cotton fibers, it is preferred to use direct dyes. Direct dyes include anionic azo, phthalocyanine, stilbene, oxazine and thiazole compounds. Preferred direct dyes are sulfonated azo compounds which are soluble in water. Suitable direct dyes for use in this invention include Direct blues such as CI-148, CI-165 or CI-218; Direct Blacks such as CI-19, CI-22 or CI-170; Direct Yellows such as CI-50 or CI-106; and Direct Reds such as CI-78, CI-80 or CI-81.

The cellulose acetate pile fibers are dyed using a disperse dye. The disperse dyes are generally nonionic dyes which are insoluble or slightly soluble in water and include azo, anthraquinone and methine compounds combined with a dispersing agent such as a lignin sulfonate to facilitate dispersions of the dye in water. Preferred disperse dyes include Disperse Blues such as CI-27, CI-102, CI-106, or CI-148; Disperse Yellows such as CI-3; and Disperse Reds such as CI-1 or CI-17.

The fabric may be dyed using conventional dying methods known in the art, either in the form of individual yarn prior to weaving the velvet fabric or, more preferably, in a single dying operation where the completed "greige" velvet fabric is contacted with a dye solution containing a mixture of the disperse dye which has a dye affinity for the cellulose acetate pile fibers and a different dye, e.g., a direct dye, which has an affinity for dying the backing fibers. Dying is generally accomplished by immersing the fabric in an aqueous solution containing the disperse dye at a concentration about 1% to about 3% by weight and the second dye, e.g., a direct dye, at a concentration of from about 2% to about 4% by weight. After the desired degree of color is imparted to the fabric, the fabric is removed from the dye solution and the dye may optionally be fixed by heat or chemical treatments as are known in the art.

The dyed fabric is then subjected to a mild hydrolysis treatment by contact with dilute alkali which is sufficient to at least partially hydrolyze the cellulose acetate pile fibers but which is insufficient to substantially degrade any of the fibers present in the fabric structure. This treatment may be carried out by immersion of the dyed fabric in an aqueous bath containing from about 0.75 to about 3.0 by weight of sodium or potassium hydroxide, preferably sodium hydroxide, for a period of from about 10 to 200 minutes, more preferably from about 10 to 90 minutes, the solution being maintained at a temperature in the range of about 100° F. to 200° F., more preferably from about 150° to 200° F. These times and temperatures may generally vary as a function of the concentration of caustic present in the bath solution. Preferably the treatment is conducted such that essentially all of the cellulose acetate present in the pile fiber is hydrolyzed, thereby converting the pile fiber into regenerated cellulose fiber. Where the fibers used in the construction of the backing comprise cellulosics such as cotton or rayon, some weakening of these fibers may occur during the hydrolysis treatment, but the hydrolysis treatment is mild enough to avoid any substantial degradation or mercerization of any of such fibers.

After completion of the hydrolysis treatment, the fabric material is separated from the alkali solution and rinsed at least once, preferably at least twice, with cool or warm water to remove as much of the excess alkali from the treated fabric as possible. Rinsing is facilitated by a last rinse wherein the rinsed fabric is contacted with a dilute aqueous acidic solution for a period of time sufficient to neutralize any residual alkali present in the fabric, and preferably to bring the fabric to a near neutral pH, e.g. pH of about 6.5 to 7.0. The acid rinse bath contains an added organic or inorganic acid such as hydrochloric, sulfuric, nitric, phosphoric, acetic, formic, oxalic or malic acid, present at a preferred concentration of from about 0.1 to about 0.5% by weight. Contact time with the acid solution of from about 1 to about 5 minutes is generally sufficient to neutralize residual alkali.

All of the above operations, i.e., dying, hydrolysis and rinsing may be conducted in a single large dying tank equipped with water inlet and discharge means such that the various solutions can be introduced into and discharged from the tank without the need to remove the fabric contained in the tank. Alternatively, the fabric can be removed from the tank after one operation and resubmerged for the subsequent operation.

A final treatment step involves contact or washing the neutralized fabric with an aqueous solution containing a cationic or non-ionic fabric softener, present in said aqueous solution at a concentration of from about 1.0% to about 3.0% by weight. The fabric softener treatment tends to promote and enhance a wrinkled effect in the velvet after drying and imparts a luxuriously soft handle to the pile. Suitable fabric softeners include polysilicones (dimethyl silicones) or aminopolysiloxanes, cationic surfactants, fatty amides, fatty sulfonates, distearyl dimethyl ammonium salts and other quaternary ammonium salts such as imidazoline salts and quaternary ammonium esters of compounds containing one or more long chain fatty acids (ester quats). Contact with the softening agent solution may generally range from about 10 to 60 minutes at a preferred solution temperature in the range of from about 70° F. to about 120° F. The fabric softener treatment may be conducted in the large dye tank described above or alternatively in a large commercial washing machine.

After completion of the fabric softener treatment, the fabric is tentered and then dried on the tenter, preferably at a temperature in the range of less than 250° F. more preferably at a temperature of from about 200° F. to 250° F. The tenter consists of a large pinned frame upon which the fabric is drawn to width and length by mounting the fabric sides and ends on the tenter pins.

The following example is illustrative of the invention.

EXAMPLE

A raw (greige) velvet fabric of 40 yards in length was provided. The fabric consisted of a rayon backing woven with cellulose monoacetate pile fibers having a height off the backing of about $6\times10^{-2}$ inch. Prior to dying, the fabric was first washed (scoured) in a commercial size washing machine to remove any sizing agents or finishing chemicals present in the fabric. The washed fabric was then pinned on a large star reel and placed in a large commercial dye tank equipped with water inlet and outlet means which was filled with a dye solution containing a blue disperse dye (1.5% by weight concentration) and a blue direct dye (3.5% by weight concentration). The fabric was left in contact with the dye solution at a solution temperature of about 200° F. for a period of about 120 minutes, after which time the dye fabric was removed from the tank. The dyed fabric was of a blue shade, with roughly equal color intensity on both the pile and the backing fibers.

The tank was then drained and filled with water. Sodium hydroxide flake was added to form a solution having a caustic concentration of about 1.2% by .weight. The solution was then heated to about 168° F. after which the dyed fabric was immersed in the tank for a period of 30 minutes. After 30 minutes contact time, the fabric was removed from the tank and the tank was drained of caustic solution and refilled with room temperature water to rinse the treated fabric. The first rinse was conducted for about 30 minutes, the tank was drained and a second rinse with fresh water was conducted for 30 minutes. After a 30 minute second rinse, the water in the tank was drained and the tank was refilled with water acidified by the addition of acetic acid at a concentration of about 0.1% by weight. The fabric was maintained in contact with the acid rinse for about 5 minutes, after which time the dyed fabric was removed from the tank. The pH of the fabric was measured at about 6.5 to 7.0.

The fabric was then conveyed to a large commercial washer and rinsed in water containing about 5% by weight of a dimethyl silicone fabric softener. Rinsing was carried out for about 5 minutes at a temperature of about 100° F.

The fabric was then removed from the washer, extracted for about 5 minutes, and pinned on a tender frame to stretch the fabric to width and length. The fabric was dried on the tenter frame using circulating hot air at a temperature of about 250° F.

The resulting fabric exhibited a two-toned bluish color effect as between the lighter pile and the darker backing. The pile was of a shiny lustrous, silvery sheen and the fabric had a luxurious, soft handle. Chemical analysis showed that the cellulose acetate pile had been converted to regenerated cellulose. In contrast, a control fabric sample which was trimmed from the dyed fabric prior to the treatment with caustic solution as described above had a comparatively bland blue tone with very little color contrast between the pile and backing.

What is claimed is:

1. A process of creating a two-toned color effect in a dyed velvet fabric composed of a dyed weaved fiber backing and containing pile comprising cellulose acetate fibers dyed with a disperse dye wherein said two-toned color effect is between said pile and said backing, said process comprising:

a) contacting said dyed fabric with a dilute aqueous alkali solution for a period of time sufficient to at least partially hydrolyze said cellulose acetate of said pile fibers and effect a reduction in the color intensity of the pile but insufficient to substantially degrade any of said fibers;

b) separating said fabric from said alkali solution; and c) rinsing said fabric with rinse water to remove excess alkali present in said fabric.

2. The process of claim 1 wherein said pile fibers are selected from the group consisting of fibers of cellulose monoacetate, cellulose diacetate, cellulose triacetate and mixtures thereof.

3. The process of claim 2 wherein said pile fibers are cellulose monoacetate.

4. The process of claim 1 wherein said dilute aqueous solution contains an alkali selected from the group consisting of sodium hydroxide and potassium hydroxide present in said solution at a concentration of from about 0.75 to about 3% by weight.

5. The process of claim 4 wherein said alkali is sodium hydroxide.

6. The process of claim 4 wherein said aqueous alkali solution is maintained at a temperature in the range of about 100° F. to 200° F. and said period of contact of said dyed fabric with said solution ranges from about 10 to about 200 minutes.

7. The process of claim 6 wherein said period of contact ranges from about 10 to about 90 minutes.

8. The process of claim 1 wherein said dyed, weaved backing is composed of fibers selected from the group consisting of rayon, cotton, polyester, nylon, acrylic, and aramide fibers, and mixtures thereof.

9. The process of claim 8 wherein said weaved backing fibers comprise rayon fibers.

10. The process of claim 8 wherein said dyed weaved backing is dyed using a non-disperse dye selected from the group consisting of direct, acid, basic, and vat dyes.

11. The process of claim 10 wherein said non-disperse dye is a direct dye.

12. The process of claim 1 further comprising the step:

d) contacting said rinsed fabric with an aqueous acidic solution for a period of time sufficient to neutralize any residual alkali present in said rinsed fabric.

13. The process of claim 12 wherein said acidic solution contains from about 0.1 to 0.5% by weight of an acid selected from the group consisting of organic and inorganic acids.

14. The process of claim 12 wherein said contact time with said acidic solution ranges from about 1 to about 5 minutes.

15. The process of claim 12 further comprising the step:

e) contacting the neutralized fabric from step (d) with an aqueous solution containing a non-ionic or cationic fabric softening agent.

16. The process of claim 15 wherein said fabric softener solution is maintained at a temperature of from about 70° F. to 120° F. and said contact time ranges from about 10 to about 60 minutes.

17. The process of claim 15 wherein the fabric from step (e) is tentered and dried at a temperature of 250° F. or less.

18. A process of creating a two-toned color effect in a dyed velvet fabric composed of a backing of weaved rayon, cotton or rayon/cotton mixture, said backing dyed using a direct dye, said fabric containing cellulose monoacetate pile fibers dyed with a disperse dye, wherein said two-toned color effect is between said pile fibers and said backing, said process comprising:

a) contacting said dyed fabric with an aqueous solution containing from about 0.75 to about 3.0 percent by weight of sodium hydroxide maintained at a temperature in the range of about 100° F. to 200° F. for a period of time of at least about 10 minutes and sufficient to hydrolyze said cellulose acetate of said pile fibers and effect a reduction in the color intensity of the pile but insufficient to substantially degrade any of said fibers;

b) separating said fabric from said sodium hydroxide solution;

c) rinsing said fabric with rinse water to remove excess alkali present in said fabric;

d) contacting said rinsed fabric with a dilute aqueous acidic solution for a period of time sufficient to lower the pH of said fabric to about neutral pH;

e) contacting said neutralized fabric with an aqueous solution containing a non-ionic or cationic fabric softening agent; and f) tentering and drying the fabric from step (e).

19. A dyed, two-toned velvet fabric prepared by the process of claim 1.

20. A dyed, two-toned velvet fabric prepared by the process of claim 18.

* * * * *